US007212170B1

(12) United States Patent
Dean et al.

(10) Patent No.: US 7,212,170 B1
(45) Date of Patent: May 1, 2007

(54) ANTENNA BEAM STEERING VIA BEAM-DEFLECTING LENS AND SINGLE-AXIS MECHANICAL ROTATOR

(75) Inventors: Jeffery A. Dean, Clermont, FL (US); Michael E. Weinstein, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/128,506

(22) Filed: May 12, 2005

(51) Int. Cl.
*H01Q 3/12* (2006.01)
*H01Q 19/06* (2006.01)

(52) U.S. Cl. ..... 343/754; 343/761; 343/766

(58) Field of Classification Search ..... 343/754, 343/758, 755, 761, 765, 766
See application file for complete search history.

(56) References Cited

U.S. PATENT DOCUMENTS 2,571,129 A * 10/1951 Hansen ..... 343/754
2,617,029 A * 11/1952 Plummer et al. ..... 343/761
2,887,684 A * 5/1959 Dexter et al. ..... 343/781 R
2,994,873 A * 8/1961 Goubau ..... 343/753
3,072,905 A * 1/1963 Gilbert ..... 343/754
3,226,658 A * 12/1965 Bowman ..... 333/1
3,226,721 A * 12/1965 Gould ..... 343/754
3,309,701 A * 3/1967 Pearson et al. ..... 342/149
4,504,835 A * 3/1985 Howard et al. ..... 343/755
5,001,494 A * 3/1991 Dorman et al. ..... 343/703
6,262,688 B1 * 7/2001 Kasahara ..... 343/766
6,556,174 B1 * 4/2003 Hamman et al. ..... 343/755
6,774,862 B2 * 8/2004 Mizuno et al. ..... 343/781 P
6,829,439 B1 * 12/2004 Sidorovich et al. ..... 398/131

* cited by examiner

*Primary Examiner*—Tan Ho
(74) *Attorney, Agent, or Firm*—Jeffrey D. Myers; Timothy D. Stanley; Peacock Myers, P.C.

(57) ABSTRACT

An antenna beam steering apparatus and method comprising providing an antenna, employing a beam-deflecting lens through which energy passing from and to the antenna is deflected, and rotating the antenna with a single-axis rotator.

12 Claims, 2 Drawing Sheets

ANTENNA BEAM STEERING VIA BEAM-DEFLECTING LENS AND SINGLE-AXIS MECHANICAL ROTATOR

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to steering of antenna beams.

2. Description of Related Art

It is often desirable to steer an antenna beam over a given area for radar and other applications. This is typically accomplished with a two-axis gimbal to mechanically rotate the antenna or by electronically changing the phases of elements in a phased array antenna. Additional methods, such as using two rotatable lenses that are independently controlled, have also been used. Hybrid mechanical and electronic implementations have also been developed.

The present invention provides a novel mechanism when cost and/or the amount of physical space available for the antenna are a concern.

BRIEF SUMMARY OF THE INVENTION

The present invention is of an antenna beam steering apparatus and method comprising: providing an antenna; employing a beam-deflecting lens through which energy passing from and to the antenna is deflected; and rotating the antenna with a single-axis rotator. In the preferred embodiment, the lens is rotatable, preferably additionally wherein rotation of the lens results in deflection of an antenna beam about an axis, more preferably additionally wherein rotation of the rotator results in movement of an antenna beam about a second axis, and most preferably additionally wherein the first and second axes are approximately orthogonal. The lens comprises a waveguide or dielectric lens. The rotator comprises a mast mounted assembly, preferably wherein the rotator comprises a helicopter mast mounted assembly.

The invention is also of an antenna beam steering apparatus and method comprising: providing an antenna; employing a beam-deflecting lens through which energy passing from and to the antenna is deflected about a first axis; and rotating the antenna via a single-axis rotator about a second axis approximately orthogonal to the first axis. In the preferred embodiment, the lens is rotatable.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention accomplishes two-dimensional beam steering by rotating the entire antenna about one axis to steer the beam about this axis and by rotating a beam-deflecting lens to steer the beam about a second, typically orthogonal, axis. Combining these two techniques steers the antenna beam over a wide area. Recall that typically two-dimensional beam steering is accomplished via a two-axis gimbal or by electronic phase control of phased array antenna elements. The present invention is a much lower-cost/complexity alternative to those traditional methods of beam steering.

Figure 1:
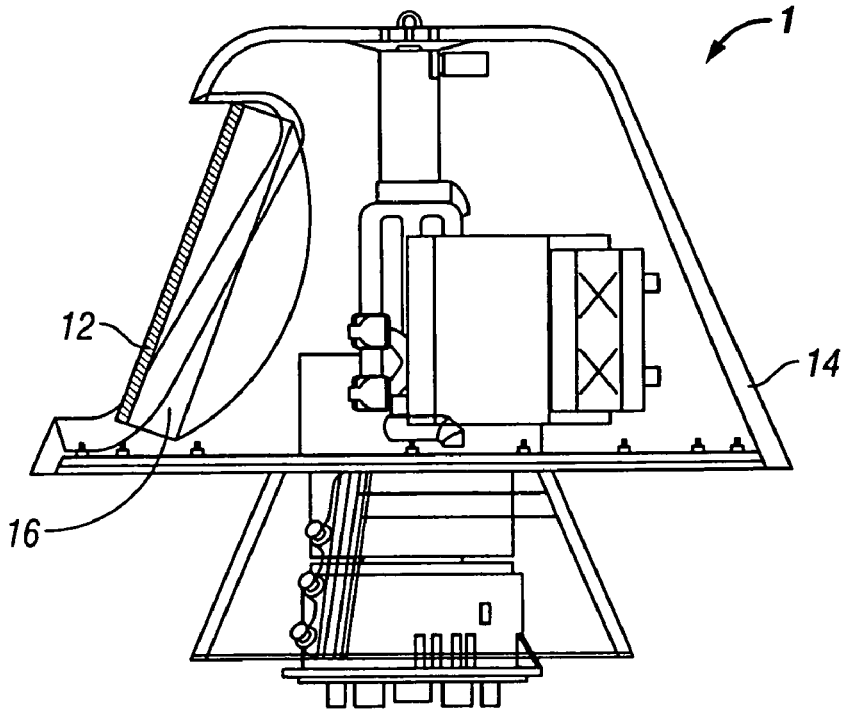
FIG. 1 illustrates an embodiment of the present invention comprising an antenna configuration for a helicopter mast mounted assembly.

Referring to FIG. 1, the present invention is illustrated in an embodiment for a helicopter mast mounted assembly (MMA) system 1 incorporating a low-cost, Ka-band steerable antenna. Typical steerable antenna approaches for this particular application are either cost prohibitive, such as an active electronically steered array or AESA, or have degraded performance due to physical space limitations, such as a mechanically steered reflector antenna. With a mechanical gimbal assembly, the antenna aperture for this particular configuration must be smaller to prevent interference with the housing, resulting in degraded performance. The present invention's novel antenna steering approach utilizes the inherent MMA rotational capability, which maximizes the antenna aperture and requires only one additional axis of rotation.

The invention comprises a rotating beam-deflecting lens 12 (preferred waveguide lens shown in FIG. 2) used in conjunction with a single-axis rotator 14 to steer the antenna beam of parabolic dish reflector antenna 16. A single-axis rotator steers the beam about one axis, and a rotating lens steers the beam about a second axis. Combining these two techniques steers the beam over a wide spatial area, as shown in FIG. 3.

For this particular application, the single-axis rotator comprises the entire MMA as rotated by a mast. For other applications, single-axis gimbals or the like can act as a single-axis rotator for the antenna. The beam-deflecting lens comprises any apparatus (such as a waveguide lens or dielectric lens) that allows a substantial amount of the incident energy to pass through it, while simultaneously introducing a graduated phase shift upon this transmitted energy. This graduated phase shift results in a deflected beam along a second axis.

Figure 2:
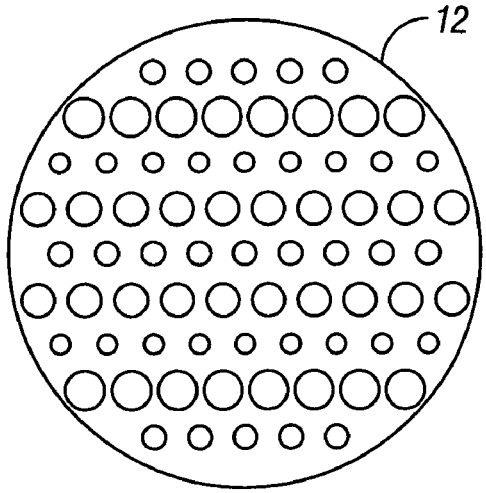
FIG. 2 illustrates an embodiment of a beam-deflecting waveguide lens useful in the present invention.

The lens is preferably designed such that the beam is deflected to the maximum extent of the desired antenna scan angle. Rotating the lens consequentially rotates the beam around the center of the lens. By moving the single-axis rotator in conjunction with the lens, the beam is steered over a wide area. FIG. 2 shows a waveguide lens viewed from the front as an example of one type of suitable beam-deflecting lens.

Figure 3:
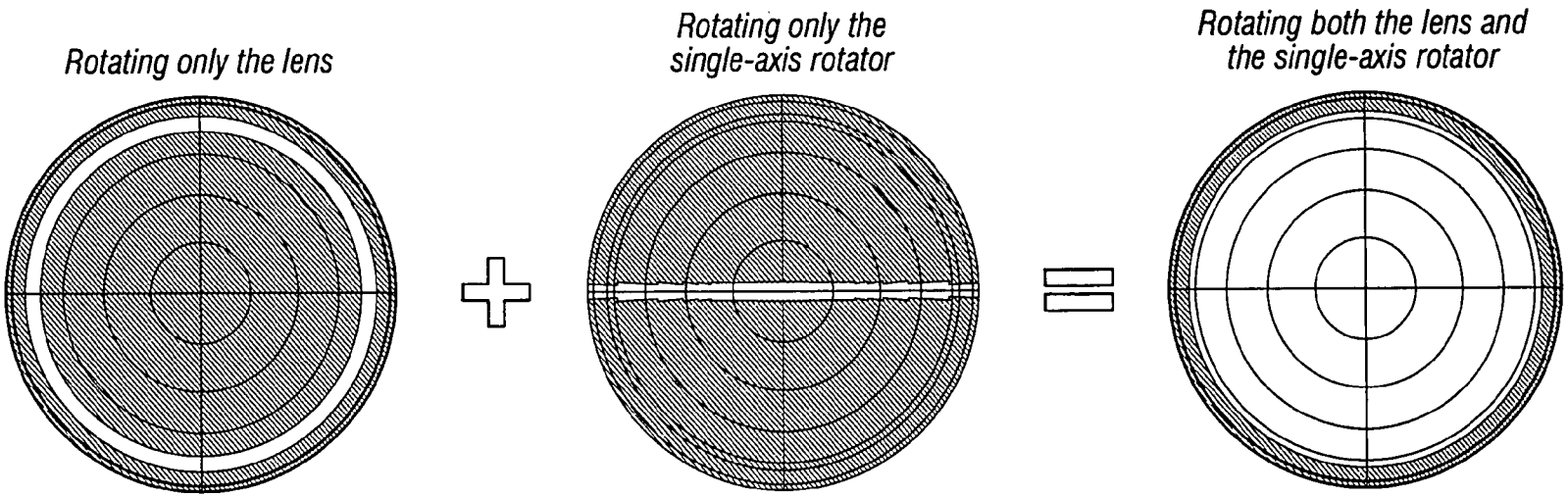
FIG. 3 illustrates antenna steering extent if only a lens is employed, extent if only a single-axis rotator is employed, and extent if both are employed in combination.

FIG. 3 shows the antenna steering extent (shaded regions) for each rotation method. Rotating only the lens steers the antenna beam along a fixed cone. Rotating only the single-axis rotator steers the antenna beam in a fixed plane. Combining the two methods enables steering over a wide angular area (within the entire cone).

For certain applications where space is limited, the present invention avoids having to reduce the size, and thus the gain, of the antenna. In addition, if one wants to change the maximum scan angle, a new lens can easily be fabricated and placed over the aperture. With a prior art AESA, increasing the maximum scan angle requires a total redesign of the antenna electronics and the radiating element architecture.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An antenna beam steering apparatus comprising:

an antenna;

a beam-deflecting lens through which energy passing from and to said antenna is deflected; and a single-axis rotator rotating said antenna; and wherein said lens is rotatable, rotation of said lens results in deflection of an antenna beam about a first axis, and rotation of said rotator results in movement of an antenna beam about a second axis.

2. The apparatus of claim 1 wherein said first and second axes are approximately orthogonal.

3. The apparatus of claim 1 wherein said lens comprises a waveguide or dielectric lens.

4. The apparatus of claim 1 wherein said rotator comprises a mast mounted assembly.

5. The apparatus of claim 4 wherein said rotator comprises a helicopter mast mounted assembly.

6. An antenna beam steering method comprising the steps of:

providing an antenna;

employing a beam-deflecting lens through which energy passing from and to the antenna is deflected; and rotating the antenna with a single-axis rotator; and wherein the lens is rotatable, rotation of the lens results in deflection of an antenna beam about a first axis, and rotation of the rotator results in movement of an antenna beam about a second axis.

7. The method of claim 6 wherein the first and second axes are approximately orthogonal.

8. The method of claim 6 wherein the lens comprises a waveguide or dielectric lens.

9. The method of claim 6 wherein the rotator comprises a mast mounted assembly.

10. The method of claim 9 wherein the rotator comprises a helicopter mast mounted assembly.

11. An antenna beam steering apparatus comprising:

an antenna;

a beam-deflecting lens through which energy passing from and to said antenna is deflected; and a single-axis rotator rotating said antenna; and wherein said rotator comprises a helicopter mast mounted assembly.

12. An antenna beam steering method comprising the steps of:

providing an antenna;

employing a beam-deflecting lens through which energy passing from and to the antenna is deflected; and rotating the antenna with a single-axis rotator; and wherein the rotator comprises a mast mounted assembly.

* * * * *